US007585403B2

(12) United States Patent
Buccolini et al.

(10) Patent No.: US 7,585,403 B2
(45) Date of Patent: Sep. 8, 2009

(54) DISPERSANT OF SALINE DEPOSITS IN HYDROCARBON PROCESS PLANTS

(75) Inventors: Marco Buccolini, Camerino MC (IT); Andrea Zanotti, Anzio RM (IT); Milena Mantarro, Rome RM (IT)

(73) Assignee: Chimec S.p.A, Rome (IT)

( * ) Notice: Subject to any disclaimer, the term of this patent is extended or adjusted under 35 U.S.C. 154(b) by 130 days.

(21) Appl. No.: 11/229,854

(22) Filed: Sep. 20, 2005

(65) Prior Publication Data

US 2006/0060498 A1 Mar. 23, 2006

(30) Foreign Application Priority Data

Sep. 20, 2004 (IT) ..... RM2004A0446

(51) Int. Cl.
*C10G 7/10* (2006.01)
*C23F 11/00* (2006.01)

(52) U.S. Cl. ..... 208/47; 203/7; 585/950

(58) Field of Classification Search ..... 203/7; 208/47; 585/950

See application file for complete search history.

(56) References Cited

U.S. PATENT DOCUMENTS

| | | | | |
|---|---|---|---|---|
| 3,189,537 | A * | 6/1965 | Carlton | 208/47 |
| 3,779,905 | A * | 12/1973 | Stedman | 208/47 |
| 4,793,865 | A | 12/1988 | Staley et al. | |
| 5,387,733 | A | 2/1995 | Weaver et al. | |
| 5,556,575 | A * | 9/1996 | Babaian-Kibala et al. | 208/47 |
| 5,900,392 | A * | 5/1999 | Bernhard | 508/154 |

FOREIGN PATENT DOCUMENTS

WO 02/099025 A 12/2002

OTHER PUBLICATIONS

Definition for "retard" available at http://www.merriam-webster.com/dictionary/retard.*

* cited by examiner

*Primary Examiner*—Glenn Caldarola
*Assistant Examiner*—Randy Boyer
(74) *Attorney, Agent, or Firm*—Browdy and Neimark, P.L.L.C.

(57) ABSTRACT

Use of diaminopropanes, or of a composition thereof as a dispersing agent to prevent the formation or remove already formed deposits of ammonium salt in hydrocarbon process plants, such as petrochemical or refinery plants.

6 Claims, 3 Drawing Sheets

50 ppm of Duomeen C with ethylenediamine chloride (100 mg) in gasoline

DISPERSANT OF SALINE DEPOSITS IN HYDROCARBON PROCESS PLANTS

TECHNICAL FIELD OF THE INVENTION

The present invention relates to the use of a dispersing agent or of a composition comprising said dispersing agent, to prevent the formation of or to remove already formed deposits of ammonium salt in hydrocarbon process plants, such as petrochemical or refinery plants.

BACKGROUND ART

In hydrocarbon process plants, the formation of saline deposits in apparatuses cause severe problems for the safety of the operations of the various process units.

Said ammonium salt deposits are formed particularly in atmospheric distillation (topping) plants and in fluid bed catalytic cracking (FCC) plants, where the head vapours of the process units are often loaded with ammonia and hydrogen chloride.

Other plants that can present problems linked with the formation of ammonium and amine chlorides are the following:

SWS (Sour Water Stripper)

Gasoline desulphuration (Unifining)

HDS—Hydrogen Desulphuration System

The most commonly formed salt is ammonium chloride. Deposits of solid ammonium chloride may form and collect on metallic surfaces and hinder the flow of gas, liquids and heat. Moreover, said deposits are highly hazardous for the development of corrosion mechanisms, known in fact as "under deposit".

Ammonium chloride deposits can occur on distillation plates, in transport lines, on the surfaces of heat exchangers, on filters.

The deposit precipitates when the product of the partial molar pressures of the ammonia and of the hydrogen chloride exceeds the stability constant (Kd) of the ammonium chloride at system temperature.

In theory, changing the operating parameters could enable to prevent the ammonium chloride from depositing, by moving them from slightly above the equilibrium curve of the dissociation—Temperature constant to slightly below the curve.

This could be obtained by lowering the aforementioned product of the partial pressures by reducing the concentration of one or the other or of both ammonia and hydrogen chloride. However, in reality changing the operating conditions is nearly always infeasible.

For the removal of ammonia salt deposits, methods have been proposed which make use of amines that are stronger bases than ammonia, such as methoxypropylamine and monoethanolamine which form liquid salts under normal operating conditions. However, said salts are usually highly viscous and it has not yet been definitively demonstrated that such amines can overcome the problem of the onset of the corrosion phenomena described above. In fact, in some cases the salts of some amines used instead of ammonia can themselves be a source of solid or semi-solid deposits, and hence they must be removed just like ammonium chloride.

U.S. Pat. No. 4,793,865 describes the use of amines containing oxygen which react with the ammonium salt forming ammonia and an amine salt with a low melting point and/or a high affinity for water. The amine salt that is insoluble in hydrocarbons exits the unit in the liquid state, together with process liquids. Examples of these amines are dimethylethanolamine, monomethylethanolamine, methoxypropylamine, monoethanolamine, monoethylethanolamine, diethylethanolamine, propanolamine, and the like.

U.S. Pat. No. 5,387,733 describes the use of a non filming polyamine for the prevention and removal of ammonium chloride deposits, indicating dimethylaminopropylamine, diethylentriamine, ethylendiamine and tris-(2-aminoethyl) amine as polyamines.

Dispersants can act in various ways, from neutralising charges on the surface of the solid ammonium chloride, to destroying the crystal matrix, to the chemical displacement of ammonia from the crystal matrix.

Prior art dispersants are efficient to prevent a saline deposit from forming. Therefore, they are efficient preventive agents.

However, they are not equally efficient to remove the saline deposit, if it has formed.

DISCLOSURE OF THE INVENTION

The problem constituting the basis for the present invention, therefore, is to provide a dispersing product which, in addition to constituting an effective preventive agent against the formation of saline deposits, is also an effective agent able to remove saline deposits already formed in hydrocarbon process plants.

Therefore, an object of the present invention are N-alkyl-1,3-diaminopropane compounds with the formula (1)

$$R—NH—(CH_2)_3—NH_2 \quad (1)$$

where R represents a straight $C_8$ through $C_{18}$ alkyl chain, for use as dispersing agents to solve the problem of preventing the formation of saline deposits of ammonium salts and removing already formed saline deposits, in hydrocarbon process plants.

Use of the aforementioned compounds as dispersing agents to prevent the formation of, or to remove already formed deposits of ammonium salt in a hydrocarbon process plant is an object of the present invention.

A further object of the present invention is a method for preventing the formation of or to remove already formed deposits of ammonium salt in a hydrocarbon process plant, comprising the step of introducing in the process of said plant a quantity of N-alkyl-1,3-diaminopropane, particularly N-coco-1,3-diaminopropane, sufficient to prevent or remove said deposits.

The compounds can be used alone or in a composition that comprises them together with suitable coadjuvants or carriers, such as, by way of non limiting examples, filming or neutralising or dispersing corrosion inhibitors for iron chloride, and in hydrocarbon process plants such as, by way of non limiting examples, an atmospheric hydrocarbon distillation plant, a fluid bed catalytic cracking (FCC) plant, a sour water stripper (SWS) plant, a gasoline desulphuring plant (Unifining), or a hydrogen desulphuration system (HDS).

Particularly preferred is the N-coco-1,3-diaminopropane compound.

This compound, also known commercially with the name Duomeen C (by Akzo Surfactants), is known for having been used as a synthesis intermediate by means of oxyethylation, to obtain emulsifiers, surfactants or polymers and it is also known, as such, as a corrosion inhibitor.

This compound, too, can be used alone or in combination or in composition with additional agents active in process operations, as filming corrosion inhibitors, neutralising corrosion inhibitors, dispersants for iron sulphide and the like.

BRIEF DESCRIPTION OF THE DRAWINGS

The invention shall now be described in detail with reference to the accompanying drawings, in which.

DETAILED DESCRIPTION OF THE INVENTION

Laboratory Tests

Laboratory tests were conduct in order exactly to measure the efficiency of the dispersant of the invention, quantifying also the quantity of salt dispersed in the examined fluid.

The following fluids were used in the test:

a) a toluene/n-heptane (RPE purity solvents)

b) head gasoline-topping c) LCO (Light Cycle diesel Oil) from FCC (fluid bed catalytic cracking) plant.

The tests were conducted placing 20 ml of fluid to be examined and 100 mg of finely subdivided ammonium chloride in a 50 ml flask with ground glass neck. The function of the fluid is to dissolve the ammonium chloride in the solution or dispersion fluid.

Once the ammonium chloride is dispersed, the fluid is allowed to rest for a defined time and subsequently a fixed quantity is drawn (being careful not to move the salt deposited on the bottom); the ammonium chloride dispersed in the fluid is extracted with a known quantity of distilled water. On this aqueous solution is performed the measurement of conductivity, which is proportional to the quantity of ammonium chloride dispersed in the initial fluid.

Figure 1:
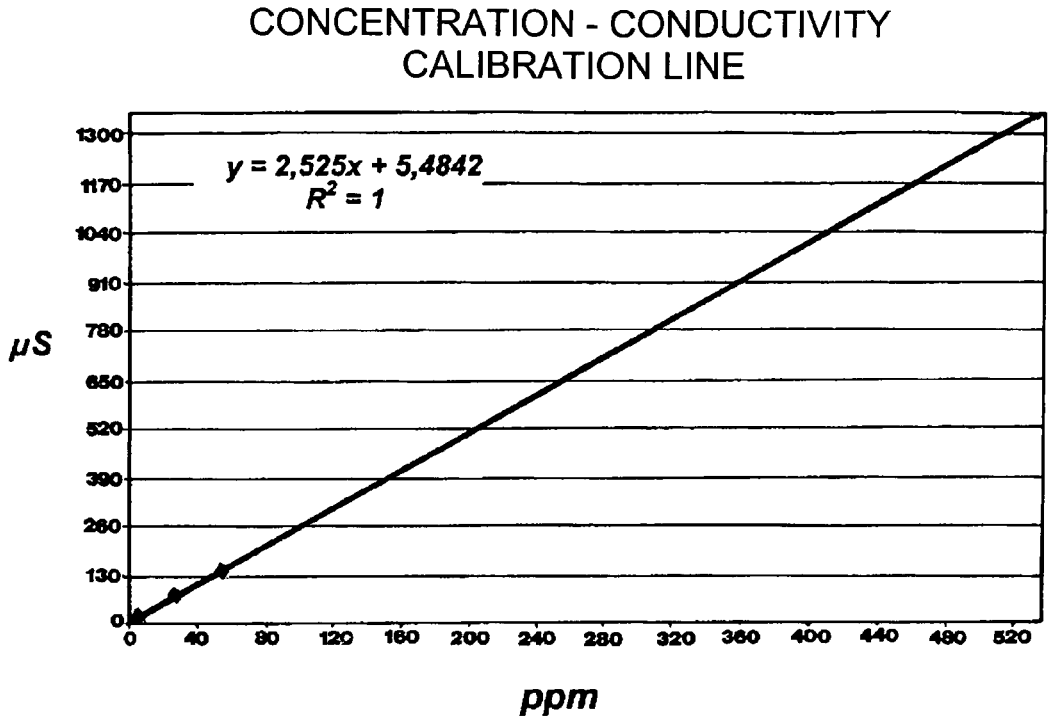
FIG. 1 is a diagram showing the concentration-conductivity calibration straight line for the determination of the efficiency of the dispersant.

A calibration straight line was constructed, as shown in FIG. 1, preparing four aqueous solutions of $NH_4Cl$ having a known concentration, respectively of 0.0001M; 0.0005M; 0.001 and 0.01 M.

The calibration was conducted by placing in water (in the fluid) some known concentrations of $NH_4Cl$ and measuring the conductivity of the solution. The conductivity of the solutions was measured in μS and shown on the chart of FIG. 1, based on Table 1 below.

TABLE 1

Concentration - conductivity correlation

| ppm | μS |
|---|---|
| 5.3 | 17.1 |
| 26.7 | 74.1 |
| 53.4 | 141 |
| 534.5 | 1353 |

In the execution of the test, the concentration read on the calibration straight line is determined from the measurement of conductivity. From the concentration, the quantity of salt removed is determined, which represents a measurement of the efficiency of the dispersant, i.e. its ability to free the ammonium chloride in the fluid being examined. Both conductivity and concentration therefore represent an objective measurement of the efficiency of the dispersant. The higher the concentration, the more efficient the dispersant, because a high concentration means a greater quantity of dispersed (removed) salt.

The efficiency of the dispersant of the present invention was compared, based on the above described test, with other dispersant known for their effectiveness. In particular, Imidazolin 1 and Imidazolin 2 were selected among said known dispersants, as well as a known dispersant by Ondeo-Nalco, hereinafter called "competitor".

Therefore, the active ingredients used in the tests are:

Duomeen C(N-coco-1,3-diaminopropane) of the present invention;

Imidazolin 1;

Imidazolin 2;

Competitor product;

The dispersing product to be tested is introduced into the fluid at the prescribed dosage.

The whole is reflux heated with vigorous agitation for ten minutes. An indicator paper is plated at the top of the refrigerant to detect any presence of acid or basic vapours. Subsequently, cooling to ambient temperature is effected while continuing to agitate.

The turbid mixtures are transferred to a test tube with stopper and are allowed to rest for different times as shown in the tables provided below.

After the rest period, 10 ml are drawn from the high part of the solution taking care not to mix the $NH_4Cl$ deposit. They are beaten with 12 ml of water in 100 ml separator funnel. As illustrated above, the measurement of the conductivity of the aqueous phase allows to determine the concentration of ammonium chloride.

As shown in the tables that follow, it is demonstrated that the dispersant exhibits improving performance as its dosage increases, but beyond a certain limit an increase in dispersant causes a decrease in additive concentration, which shows that it has an optimal efficiency at relatively low concentrations.

The dispersant according to the present invention exhibits better efficiency than the aforementioned known dispersant, as shown by the parallel tests illustrated in the Tables 1-3 that follow, where the concentration values represent an objective measure to compare dispersion ability and efficiency is measured by the numeric ratio between the ppm of additive of the invention (Duomeen C) and the ammonium chloride concentration expressed in ppm.

EXAMPLE 1

Comparison Test, in Toluene/n-Heptane Mixture, After One Hour of Rest

TABLE 2

| Additive | Conductivity (μS) | Concentration $NH_4Cl$ (mg/l) | ppm of additive ppm of $NH_4Cl$ |
|---|---|---|---|
| Duomeen C (50 ppm) | 128 | 48.1 | 1.04 |
| Imidazolina (50 ppm) | 162 | 22.2 | 2.25 |
| Imidazolina (50 ppm) | 278 | 28.5 | 1.75 |

Other concentrations of dispersant according to the invention were evaluated and shown in Table 3. It should be noted that with lower dosage the ratio between product and removed salt is still more favourable. Instead, between 50 and 100 ppm the quantity of dispersed ammonium chloride does not increase and clearly the ratio worsens sharply. This surprisingly demonstrates that a large quantity of additive according to the present invention is not necessary to obtain excellent efficiency results.

TABLE 3

| Additive | Conductivity (μS) | Concentration $NH_4Cl$ (mg/l) | ppm of additive ppm of $NH_4Cl$ |
|---|---|---|---|
| Duomeen C | | | |
| (5 ppm) | 68 | 24.6 | 0.2032 |
| (10 ppm) | 89 | 32.8 | 0.3048 |
| (25 ppm) | 102 | 37.9 | 0.6596 |
| (50 ppm) | 128 | 48.1 | 1.0395 |
| (100 ppm) | 86 | 31.6 | 3.1645 |

Table 4 below shows the results of the test on a dispersant product known in the art and called Competitor.

TABLE 4

| Competitor | Conductivity (μS) | Concentration $NH_4Cl$ (mg/l) | ppm of additive ppm of $NH_4Cl$ |
|---|---|---|---|
| 50 | 33 | 11.27 | 4.43 |
| 100 | 30 | 10.10 | 9.90 |
| 250 | 28 | 9.33 | 26.79 |
| 2000 | 43 | 15.16 | 131.92 |

The comparison of the parallel results (50 and 100 ppm) of Table 3 with those of Table 2 shows that the coefficient of efficiency of Duomeen C is better by a factor of about four than that of the Competitor (Table 3).

EXAMPLE 2

Series of Tests in LCO (Light Cycle Diesel Oil) After One Hour of Rest

The above tests were repeated using LCO as the dispersion fluid and the comparable results are shown in the tables that follow.

TABLE 5

| Additive | Conductivity (μS) | Concentration $NH_4Cl$ (mg/l) | ppm of additive ppm of $NH_4Cl$ |
|---|---|---|---|
| Duomeen C | | | |
| (50 ppm) | 219 | 83.8 | 0.5966 |
| (100 ppm) | 348 | 134 | 0.7462 |
| (200 ppm) | 341 | 131 | 1.2567 |
| (400 ppm) | 410 | 158 | 2.53 |
| (800 ppm) | 472 | 183 | 4.3715 |

TABLE 6

| Additive | Conductivity (μS) | Concentration $NH_4Cl$ (mg/l) | ppm of additive ppm of $NH_4Cl$ |
|---|---|---|---|
| Imidazolin 1 | | | |
| (50 ppm) | 127 | 47.7 | 1.048 |
| (100 ppm) | 112 | 41.8 | 2.388 |

TABLE 6-continued

| Additive | Conductivity (μS) | Concentration $NH_4Cl$ (mg/l) | ppm of additive ppm of $NH_4Cl$ |
|---|---|---|---|
| Imidazolin 2 | | | |
| (50 ppm) | 111 | 41.4 | 1.207 |
| (100 ppm) | 203 | 77.5 | 1.298 |
| (200 ppm) | 300 | 115 | 1.739 |
| (400 ppm) | 348 | 134 | 2.985 |
| (800 ppm) | 364 | 140 | 5.714 |

The results shown demonstrate the superior efficiency of Duomeen C as a dispersant according to the present invention with respect to the two comparison dispersant, particularly in relation to the use of lower dosages of the dispersant in a fluid that mimes different process conditions from those of example 1.

EXAMPLE 3

Series of Tests in LCO/One Hour of Rest with Granular Ammonium Chloride

The experiment with 800 ppm of Duomeen C was duplicated using ammonium chloride in granular form, instead of finely pulverised, as in the previous experiments, with the results shown in Table 7 below.

TABLE 7

| Additive | Conductivity (μS) | Concentration $NH_4Cl$ (mg/l) | ppm of additive ppm of $NH_4Cl$ |
|---|---|---|---|
| Duomeen C (800 ppm) | 217 | 83 | 9.6385 |

100 mg of granular $NH_4Cl$

Although conductivity (and hence the quantity of dispersed salt) is lower than that obtained with the fine powder (Table 5 of Example 2), there is still significant dispersion. This is very important, because it demonstrates that the chosen dispersant is not only able to have preventive effect with respect to the depositing of small ammonium chloride particles, but it also attacks granular depositing, bringing a part of the salt to the hydrocarbon phase, even if it must be dosed in greater quantity.

EXAMPLE 4

Series of Tests in LCO/14 Hours of Rest

TABLE 8

| Additive | Conductivity (μS) | Concentration $NH_4Cl$ (mg/l) | ppm of additive ppm of $NH_4Cl$ |
|---|---|---|---|
| Duomeen C | | | |
| (100 ppm) | 25.2 | 7.80 | 12.82 |
| (200 ppm) | 44.1 | 15.20 | 13.15 |
| (400 ppm) | 60.8 | 21.76 | 18.38 |
| (800 ppm) | 122.3 | 45.91 | 17.42 |
| Imidazoline 2 | | | |
| (200 ppm) | 35 | 11.24 | 17.79 |
| (800 ppm) | 38 | 12.81 | 62.45 |

Comparing the Table 8 with the Table 6 of Example 2, it is apparent that the rest time is a factor that lowers the dispersing ability of the dispersants. However, for a rest of 14 hours, while the efficiency factor of Imidazoline 2 relating to a 200 mg dose goes from 1.739 to 17.79, thereby worsening by a factor of about 10, Duomeen C goes from 1.53 to 13.15, worsening by a factor of about 8.6 i.e. less than the comparison Imidazoline 2. However, at the dose of 800 mg, the factor worsens for Imidazoline 2 from 5.714 to 62.45, i.e. 10.9 times, whilst for Duomeen C the factors goes from 4.37 to 17.42 i.e. it increases by only 4 times. This demonstrates the high ability of the dispersant according to the invention to remove and maintain in dispersion deposits already formed or being formed.

EXAMPLE 5

Series of Tests in LCO/Fixed Dosage (50 ppm)/Increasing Time

This test tends to determine, also in LCO, what happens at fixed dosage (50 ppm) monitoring effectiveness over time. From the data obtained and shown in Table 8, it is readily apparent that already within one hour the quantity of ammonium chloride in dispersion greatly decreases. This trend is also readily apparent visually, because so long as the solution remains turbid, conductivity is very high. When the solution clears up, i.e. after one hour, conductivity plummets and remains nearly constant for all the subsequent 14 hours.

This part of salt almost seems to be chemically bonded to the dispersant, and in fact it remains practically dissolved in the hydrocarbon phase.

TABLE 9

| Sample | Minutes of rest (Conductivity) | | | | |
|---|---|---|---|---|---|
| Duomeen C (50 ppm) | 15 (1970) | 30 (1181) | 60 (219) | 120 (204) | (300) (62) |
| Imidazoline 2 (50 ppm) | 15 (1186) | 30 (560) | 60 (111) | 120 (101) | 300 (28) |

EXAMPLE 6

Series of Tests in Top Topping Gasoline/1 Hour of Rest

The tests conducted on a sample of top topping gasoline are illustrated as an additional example of fluid within which the dispersing product is tested. The first results are evaluated after one hour of rest of the gasoline, following the dispersion of the finely subdivided ammonium chloride.

The results shown in Table 10 below reflect fairly faithfully those obtained with the toluene/n-heptane mixture of solvents. Conductivity values are lower than those obtained with LCO (which is evidently more polar or contains more humidity). The white (ammonium chloride dispersed in gasoline, without dispersing products, shows nearly nil conductivity (4 μs) after one hour.

TABLE 10

| Additive | Conductivity (μS) | Concentration $NH_4Cl$ (mg/l) | ppm of additive ppm of $NH_4Cl$ |
|---|---|---|---|
| Duomeen C | | | |
| (5 ppm) | 46 | 15.951 | 0.31 |
| (10 ppm) | 106 | 39.808 | 0.25 |

TABLE 10-continued

| Additive | Conductivity (μS) | Concentration $NH_4Cl$ (mg/l) | ppm of additive ppm of $NH_4Cl$ |
|---|---|---|---|
| (25 ppm) | 129 | 48.54 | 0.51 |
| (50 ppm) | 142 | 54.06 | 0.92 |
| Imidazoline 1 | | | |
| (10 ppm) | 71 | 25.76 | 0.38 |
| (50 ppm) | 84 | 30.87 | 1.62 |
| Imidazoline 2 | | | |
| (10 ppm) | 49 (35) | 17.13 | 0.58 |
| (50 ppm) | 65 (38) | 23.41 | 2.13 |

EXAMPLE 7

Series of Tests in Top Topping Gasoline/with 14 Hours of Rest

This example demonstrates that the efficiency of Duomeen C as a dispersant over time is from 3 times (imidazolin 1) to 5 times greater than dispersants known in the prior art. The direct comparison is illustrated in Table 11 below.

TABLE 11

| Additive | Conductivity (μS) | Concentration $NH_4Cl$ (mg/l) | ppm of additive ppm of $NH_4Cl$ |
|---|---|---|---|
| Duomeen C (200 ppm) | 87 | 32.05 | 6.24 |
| Imidazoline 1 (200 ppm) | 21 | 6.13 | 32.62 |
| Imidazoline 2 (200 ppm) | 33 | 10.84 | 18.45 |

EXAMPLE 8

Series of Tests in Top Topping Gasoline/1 hour of Rest with Ethylendiamine Chloride In this example, the measurements were taken not dispersing ammonium chloride any more, but rather ethylendiamine chloride: this amine is amply used as a neutraliser for topping top, instead of ammonia. It is a stronger base and it reacts with two aminic groups. However, it has the drawback of forming amine chloride deposits, solid even at very high temperatures.

The salt was precipitated after neutralising the amine with hydrogen chloride, and then re-dissolved and re-precipitated by acetone, thereby forming needle-like micro-crystals.

In water, the ethylendiamine salt conducts more or less like ammonium chloride (20 ppm of salt raise μS conductivity to 49, whereas ammonium chloride reaches the same value with 18 ppm). The results are illustrated in Table 12 below.

TABLE 12

| DUOMEEN C | CONDUCTIVITY (μS) | CONCENTRATION (mg/l) | ppm of additive ppm EDA * $(HCL)_2$ |
|---|---|---|---|
| WHITE | 45 | 18.1 | |
| (10 ppm) | 145 | 65.4 | 0.15 |
| (50 ppm) | 125 | 56.0 | 0.89 |

This example demonstrates that the dispersant of the present invention is effective not only against deposits of ammonium chloride, but also against other amine chlorides, notoriously tending to form persistent deposits.

EXAMPLE 9

Series of Transmittance Tests Versus Time test without dispersing treatment: 100 mg of ammonium chloride in 20 cc of gasoline With an instrument that measures transmittance, the transmittance was measured of an IR radiation, made to pass through a test tube containing a more or less turbid dispersion (solution) of ammonium chloride or an amine salt. The more turbid the dispersion (solution), the lesser the transmittance (values around 0%).

The results are shown in the charts of FIGS. 2 through 5. In the charts, transmittance, expressed in %, is shown along the x-axis, while on the y-axis is shown, in cm, the length from the meniscus (0-1 cm) to the bottom (7 cm) of the test tube. Each curve of the chart expresses the transmittance (limpidity) of the dispersion (solution) at a certain height of the test tube and after a certain time (minutes) has elapsed from the agitation of the solution, as shown on each curve.

Figure 2:
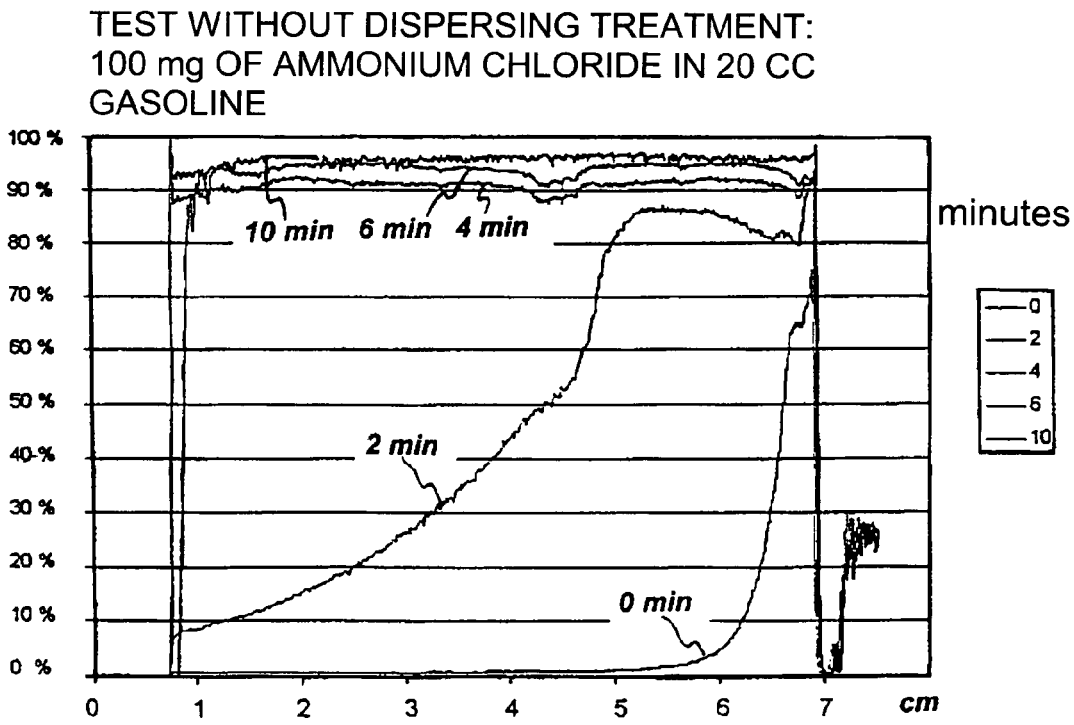
FIG. 2 shows curves determined in successive times in a transmittance test along a test tube with 100 mg of ammonium chloride in 20 cc of gasoline without dispersant.
Figure 3:
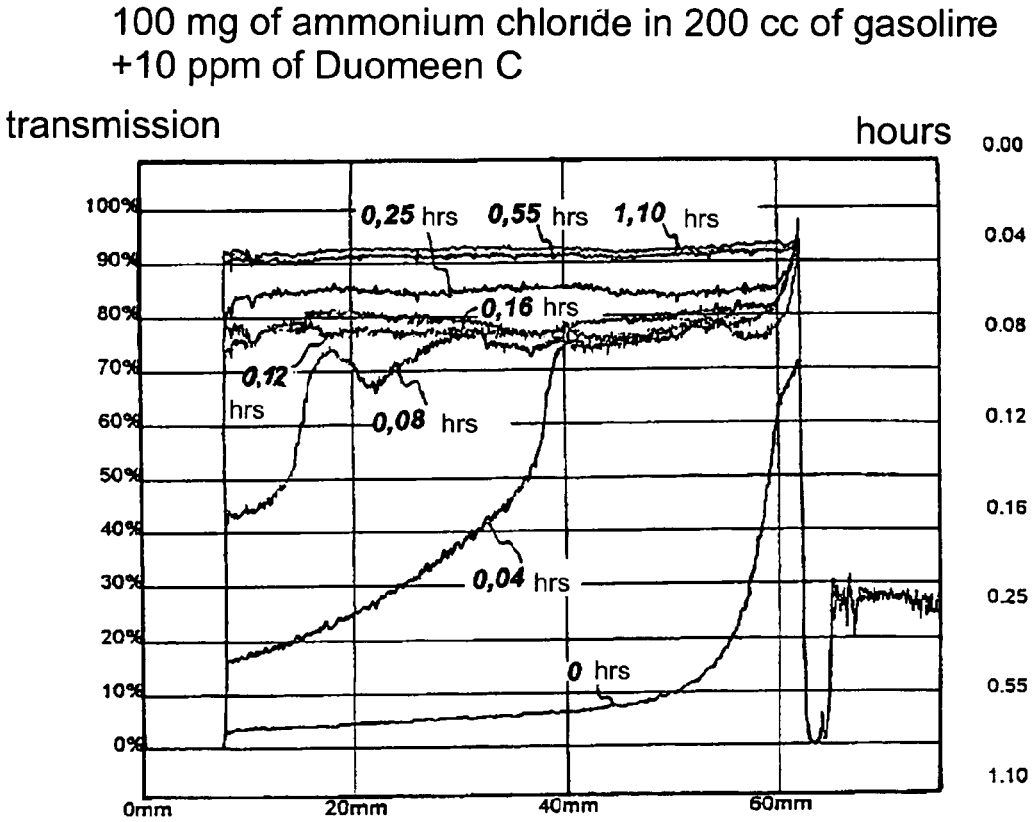
FIG. 3 shows the test conducted with 100 mg of ammonium chloride in 20 cc of gasoline and with 10 ppm of a dispersant with formula (1)
Figure 4:
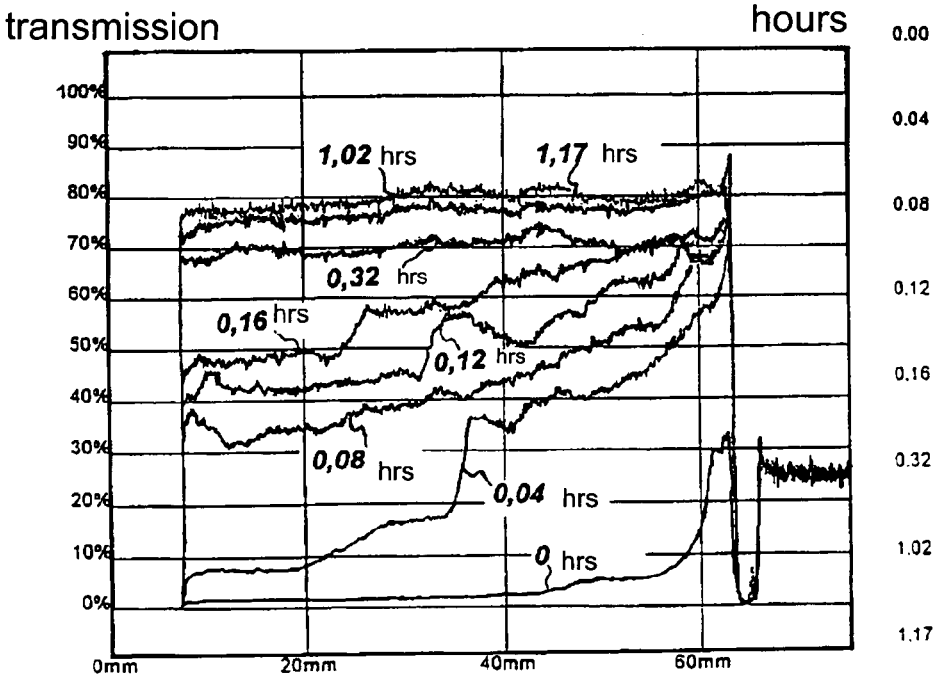
FIG. 4 shows the test conducted with 100 mg of ammonium chloride in 20 cc of gasoline and with 50 ppm of a dispersant with formula (1)

With reference to FIG. 2 (test without dispersing treatment on 100 mg of ammonium chloride in 20 cc of gasoline), as soon as ammonium chloride is agitated in gasoline, the solution becomes turbid and the instrument measures strong turbidity (line 0 minutes with zero transmittance).

As the solution becomes progressively more limpid, the value of transmittance increases (on the 2 minute line, it is already half limpid and half turbid) and on the 4 minute line it is completely limpid and the salt is all deposited on the bottom.

At time zero, the reading was done immediately after 15 minutes of agitation with heat; subsequently, the measurements were obtained at 2, 4, 6 and 10 minutes, without removing the test tube from the instrument and hence without any further agitation. After merely 10 minutes, without dispersants, ammonium chloride is all on the bottom and there is no more turbidity (nearly 100% transmittance).

Figure 5:
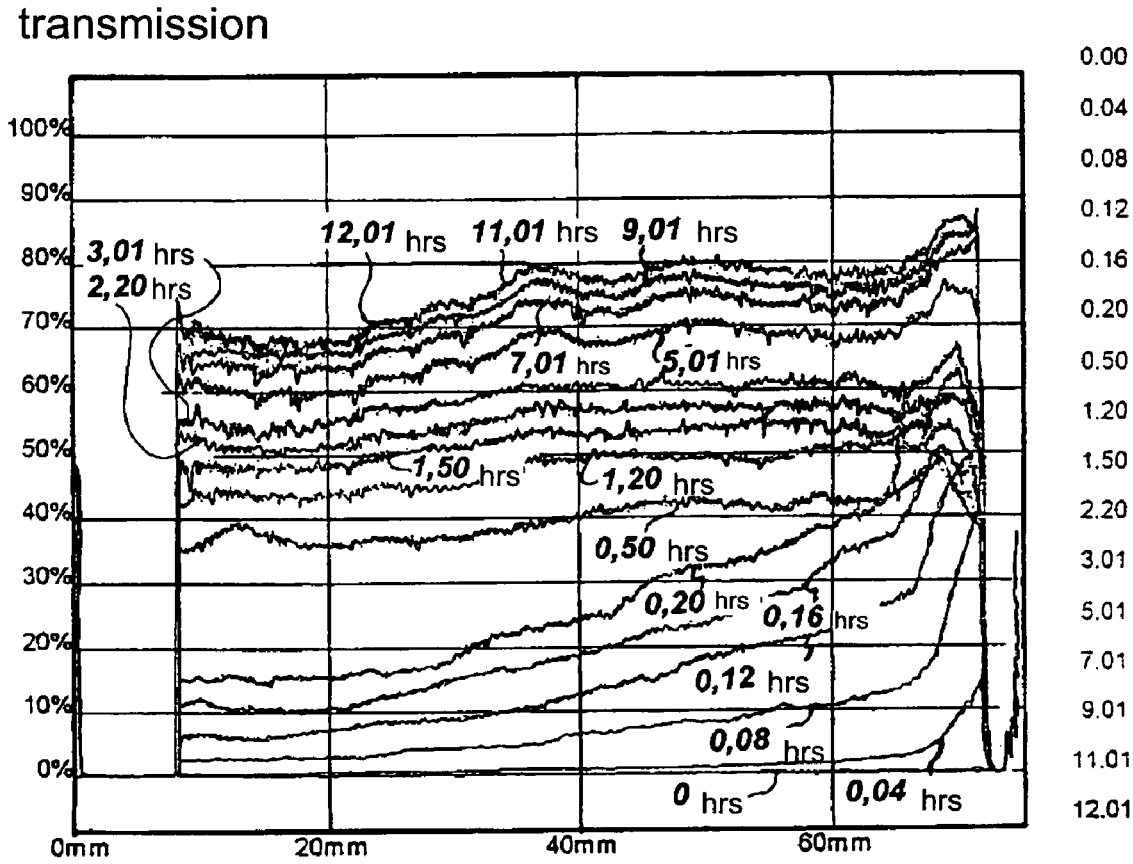
FIG. 5 shows the test conducted with 100 mg of ethylendiamine chloride in 20 cc of gasoline and with 50 ppm of a dispersant with formula (1).

It is evident with the with the presence of the dispersants (FIGS. 3 to 5), the solution becomes limpid much more gradually, and in fact, with 50 ppm Duomeen C (FIG. 4), even after more than one hour the solution still does not reach 100% transmittance. This confirms the ability of the dispersant according to the invention to maintain in dispersion ammonium chloride (FIGS. 3 and 4) or ethylendiamine (FIG. 5).

Having described the invention in its preferred embodiments, it is understood that it can be subject to modifications and variants, without thereby departing from the scope of the invention.

The invention claimed is:

1. A method of preventing the formation of and removing already formed deposits of ammonium salts, amine salts or mixtures of ammonium salts and amine salts in a hydrocarbon process plant consisting of introducing into said plant as the sole agent to prevent the formation of and to remove already formed deposits of ammonium and/or amine salts and/or their mixtures an N-alkyl-1,3-diaminopropane of formula $$R—NH—(CH_2)_3—NH_2 \quad (1)$$

where R represents a straight $C_8$ through $C_{18}$ alkyl chain, in a dispersing quantity sufficient to prevent the formation of said deposits, if not present, and to remove said deposits, if present.

2. The method as claimed in claim 1, wherein said N-alkyl-1,3-diaminopropane is N-coco-1,3-diaminopropane.

3. The method as claimed in claim 1, wherein said ammonium salt is an ammonium halogenide and said amine salts are amine halogenides.

4. The method as claimed in claim 3, wherein said ammonium salt is ammonium chloride and said amine salts are amine chlorides.

5. The method as claimed in claim 1, wherein said plant is an atmospheric hydrocarbon distillation plant, a fluid bed catalytic cracking (FCC) plant, a sour water stripper (SWS) plant, a gasoline desulphuring plant (Unifining), or a hydrogen desulphuration system (HDS).

6. The method as claimed in claim 1, wherein, in case of deposits removal, a molar ratio between said dispersing quantity and said deposits is less than one.

* * * * *